US009243391B2

(12) United States Patent
Jonte et al.

(10) Patent No.: US 9,243,391 B2
(45) **Date of Patent: *Jan. 26, 2016**

(54) MULTI-MODE HANDS FREE AUTOMATIC FAUCET

(71) Applicant: Delta Faucet Company, Indianapolis, IN (US)

(72) Inventors: Patrick B. Jonte, Zionsville, IN (US); Robert W. Rodenbeck, Indianapolis, IN (US); David M. Burke, Taylor, MI (US); Garry Robin Marty, Fishers, IN (US)

(73) Assignee: Delta Faucet Company, Indianapolis, IN (US)

( * ) Notice: Subject to any disclaimer, the term of this patent is extended or adjusted under 35 U.S.C. 154(b) by 57 days.

This patent is subject to a terminal disclaimer.

(21) Appl. No.: 14/020,315

(22) Filed: Sep. 6, 2013

(65) Prior Publication Data

US 2014/0000733 A1 Jan. 2, 2014

Related U.S. Application Data

(60) Continuation of application No. 12/648,486, filed on Dec. 29, 2009, now Pat. No. 8,528,579, which is a division of application No. 11/641,574, filed on Dec. 19, 2006, now Pat. No. 7,690,395, which is a (Continued)

(51) Int. Cl.

| | |
|---|---|
| ***F16K 31/02*** | (2006.01) |
| ***G05D 7/06*** | (2006.01) |
| ***E03C 1/05*** | (2006.01) |

(52) U.S. Cl.

CPC . *E03C 1/057* (2013.01); *E03C 1/05* (2013.01); *Y10T 137/0318* (2015.04); *Y10T 137/8158* (2015.04); *Y10T 137/8175* (2015.04);

(Continued)

(58) Field of Classification Search

CPC ..... F16K 31/02; E03C 1/057; C03C 1/05
USPC ..... 137/551, 801; 251/129.04; 4/623
See application file for complete search history.

(56) References Cited

U.S. PATENT DOCUMENTS

| | | | |
|---|---|---|---|
| 2,991,481 | A | 7/1961 | Book |
| 3,081,594 | A | 3/1963 | Atkins et al. |
| 3,151,340 | A | 10/1964 | Teshima |

(Continued)

FOREIGN PATENT DOCUMENTS

| | | |
|---|---|---|
| CA | 2492226 A1 | 7/2005 |
| DE | 3339849 | 5/1985 |

(Continued)

OTHER PUBLICATIONS

Camacho et al., Freescale Semiconductor, "Touch Pad System Using MC34940/MC33794 E-Field Sensors," Feb. 2006, 52 pgs.

(Continued)

*Primary Examiner* — Kevin Lee
(74) *Attorney, Agent, or Firm* — Faegre Baker Daniels LLP

(57) ABSTRACT

A faucet includes a spout, a handle, and a capacitive sensor operably coupled to at least one of the spout and the handle. An electrically operable valve is configured to control water flow through the spout. A mode indicator includes a light emitting device configured to provide an indication of a plurality of modes of operation of the faucet.

27 Claims, 7 Drawing Sheets

Related U.S. Application Data continuation-in-part of application No. 10/755,581, filed on Jan. 12, 2004, now Pat. No. 7,150,293, and a continuation-in-part of application No. 11/325,128, filed on Jan. 4, 2006, now Pat. No. 7,997,301.

(60) Provisional application No. 60/662,107, filed on Mar. 14, 2005.

(52) U.S. Cl.
CPC .. *Y10T137/86389* (2015.04); *Y10T 137/87917* (2015.04); *Y10T 137/9464* (2015.04)

(56) References Cited

U.S. PATENT DOCUMENTS

| | | | |
|---|---|---|---|
| 3,254,313 | A | 5/1966 | Atkins et al. |
| 3,314,081 | A | 4/1967 | Atkins et al. |
| 3,333,160 | A | 7/1967 | Gorski |
| 3,406,941 | A | 10/1968 | Ichimori et al. |
| 3,588,038 | A | 6/1971 | Tanaka |
| 3,651,989 | A | 3/1972 | Westrich |
| 3,685,541 | A | 8/1972 | Braucksick et al. |
| 3,705,574 | A | 12/1972 | Duncan |
| 3,765,455 | A | 10/1973 | Countryman |
| 3,799,171 | A | 3/1974 | Patel |
| 3,987,819 | A | 10/1976 | Scheuermann |
| 4,185,336 | A | 1/1980 | Young |
| 4,201,518 | A | 5/1980 | Stevenson |
| 4,290,052 | A | 9/1981 | Eichelberger et al. |
| 4,295,132 | A | 10/1981 | Burney et al. |
| 4,331,292 | A | 5/1982 | Zimmer |
| 4,337,388 | A | 6/1982 | July |
| 4,359,186 | A | 11/1982 | Kiendl |
| 4,406,313 | A | 9/1983 | Bennett et al. |
| 4,407,444 | A | 10/1983 | Knebel et al. |
| 4,409,694 | A | 10/1983 | Barrett et al. |
| 4,410,791 | A | 10/1983 | Eastep |
| 4,420,811 | A | 12/1983 | Tarnay et al. |
| 4,421,269 | A | 12/1983 | Ts'ao |
| 4,424,767 | A | 1/1984 | Wicke et al. |
| 4,429,422 | A | 2/1984 | Wareham |
| 4,436,983 | A | 3/1984 | Solobay |
| 4,439,669 | A | 3/1984 | Ryffel |
| 4,450,829 | A | 5/1984 | Morita et al. |
| 4,459,465 | A | 7/1984 | Knight |
| 4,503,575 | A | 3/1985 | Knoop et al. |
| 4,537,348 | A | 8/1985 | Gossi |
| 4,541,562 | A | 9/1985 | Zukausky |
| 4,554,688 | A | 11/1985 | Puccerella |
| 4,563,780 | A | 1/1986 | Pollack |
| 4,567,350 | A | 1/1986 | Todd, Jr. |
| 4,581,707 | A | 4/1986 | Millar |
| 4,584,463 | A | 4/1986 | Klages et al. |
| 4,604,515 | A | 8/1986 | Davidson |
| 4,606,325 | A | 8/1986 | Lujan |
| 4,611,757 | A | 9/1986 | Saether |
| 4,628,902 | A | 12/1986 | Comber |
| 4,638,147 | A | 1/1987 | Dytch et al. |
| 4,674,678 | A | 6/1987 | Knebel et al. |
| 4,680,446 | A | 7/1987 | Post |
| 4,682,581 | A | 7/1987 | Laing et al. |
| 4,682,728 | A | 7/1987 | Oudenhoven et al. |
| 4,688,277 | A | 8/1987 | Kakinoki et al. |
| 4,700,884 | A | 10/1987 | Barrett et al. |
| 4,700,885 | A | 10/1987 | Knebel |
| 4,709,728 | A | 12/1987 | Ying-Chung |
| 4,713,525 | A | 12/1987 | Eastep |
| 4,716,605 | A | 1/1988 | Shepherd et al. |
| 4,735,357 | A | 4/1988 | Gregory et al. |
| 4,738,280 | A | 4/1988 | Oberholtzer |
| 4,742,456 | A | 5/1988 | Kamena |
| 4,750,472 | A | 6/1988 | Fazekas |
| 4,753,265 | A | 6/1988 | Barrett et al. |
| 4,756,030 | A | 7/1988 | Juliver |
| 4,757,943 | A | 7/1988 | Sperling et al. |
| 4,761,839 | A | 8/1988 | Ganaway |
| 4,762,273 | A | 8/1988 | Gregory et al. |
| 4,768,705 | A | 9/1988 | Tsutsui et al. |
| 4,786,782 | A | 11/1988 | Takai et al. |
| 4,798,224 | A | 1/1989 | Haws |
| 4,808,793 | A | 2/1989 | Hurko |
| 4,832,259 | A | 5/1989 | Vandermeyden |
| 4,845,316 | A | 7/1989 | Kaercher |
| 4,854,498 | A | 8/1989 | Stayton |
| 4,869,287 | A | 9/1989 | Pepper et al. |
| 4,869,427 | A | 9/1989 | Kawamoto et al. |
| 4,870,986 | A | 10/1989 | Barrett et al. |
| 4,872,485 | A | 10/1989 | Laverty |
| 4,875,623 | A | 10/1989 | Garris |
| 4,893,653 | A | 1/1990 | Ferrigno |
| 4,896,658 | A | 1/1990 | Yonekubo et al. |
| 4,901,915 | A | 2/1990 | Sakakibara |
| 4,909,435 | A | 3/1990 | Kidouchi et al. |
| 4,914,758 | A | 4/1990 | Shaw |
| 4,916,613 | A | 4/1990 | Lange et al. |
| 4,917,142 | A | 4/1990 | Laing et al. |
| 4,921,211 | A | 5/1990 | Novak et al. |
| 4,923,116 | A | 5/1990 | Homan |
| 4,930,551 | A | 6/1990 | Haws |
| 4,936,289 | A | 6/1990 | Peterson |
| 4,941,608 | A | 7/1990 | Shimizu et al. |
| 4,945,942 | A | 8/1990 | Lund |
| 4,945,943 | A | 8/1990 | Cogger |
| 4,955,535 | A | 9/1990 | Tsutsui et al. |
| 4,965,894 | A | 10/1990 | Baus |
| 4,967,794 | A | 11/1990 | Tsutsui et al. |
| 4,969,598 | A | 11/1990 | Garris |
| 4,970,373 | A | 11/1990 | Lutz et al. |
| 4,971,106 | A | 11/1990 | Tsutsui et al. |
| 4,981,158 | A | 1/1991 | Brondolino et al. |
| 4,985,944 | A | 1/1991 | Shaw |
| 4,995,585 | A | 2/1991 | Gruber et al. |
| 4,998,673 | A | 3/1991 | Pilolla |
| 5,009,572 | A | 4/1991 | Imhoff et al. |
| 5,012,124 | A | 4/1991 | Hollaway |
| 5,020,127 | A | 5/1991 | Eddas et al. |
| 5,033,508 | A | 7/1991 | Laverty |
| 5,033,715 | A | 7/1991 | Chiang |
| 5,040,106 | A | 8/1991 | Maag |
| 5,042,524 | A | 8/1991 | Lund |
| 5,056,712 | A | 10/1991 | Enck |
| 5,057,214 | A | 10/1991 | Morris |
| 5,058,804 | A | 10/1991 | Yonekubo et al. |
| 5,063,955 | A | 11/1991 | Sakakibara |
| 5,073,991 | A | 12/1991 | Marty |
| 5,074,520 | A | 12/1991 | Lee et al. |
| 5,086,526 | A | 2/1992 | Van Marcke |
| 5,092,560 | A | 3/1992 | Chen |
| 5,095,945 | A | 3/1992 | Jensen |
| 5,105,846 | A | 4/1992 | Britt |
| 5,124,934 | A | 6/1992 | Kawamoto et al. |
| 5,125,433 | A | 6/1992 | DeMoss et al. |
| 5,129,034 | A | 7/1992 | Sydenstricker |
| 5,133,089 | A | 7/1992 | Tsutsui et al. |
| 5,139,044 | A | 8/1992 | Otten et al. |
| 5,143,049 | A | 9/1992 | Laing et al. |
| 5,148,824 | A | 9/1992 | Wilson et al. |
| 5,170,361 | A | 12/1992 | Reed |
| 5,170,514 | A | 12/1992 | Weigert |
| 5,170,816 | A | 12/1992 | Schnieders |
| 5,170,944 | A | 12/1992 | Shirai |
| 5,174,495 | A | 12/1992 | Eichholz et al. |
| 5,175,892 | A | 1/1993 | Shaw |
| 5,183,029 | A | 2/1993 | Ranger |
| 5,184,642 | A | 2/1993 | Powell |
| 5,187,816 | A | 2/1993 | Chiou |
| 5,202,666 | A | 4/1993 | Knippscheer |
| 5,205,318 | A | 4/1993 | Massaro et al. |
| 5,206,963 | A | 5/1993 | Wiens |
| 5,217,035 | A | 6/1993 | Van Marcke |
| 5,224,509 | A | 7/1993 | Tanaka et al. |
| 5,224,685 | A | 7/1993 | Chiang et al. |
| 5,243,717 | A | 9/1993 | Yasuo |
| D340,279 | S | 10/1993 | Mattis |

(56) References Cited

U.S. PATENT DOCUMENTS 5,257,341 A 10/1993 Austin et al.
5,261,443 A 11/1993 Walsh
5,262,621 A 11/1993 Hu et al.
5,265,318 A 11/1993 Shero
5,277,219 A 1/1994 Lund
5,281,808 A 1/1994 Kunkel
5,287,570 A 2/1994 Peterson et al.
5,309,940 A 5/1994 Delabie et al.
5,315,719 A 5/1994 Tsutsui et al.
5,322,086 A 6/1994 Sullivan
5,323,803 A 6/1994 Blumenauer
5,325,822 A 7/1994 Fernandez
5,334,819 A 8/1994 Lin
5,341,839 A 8/1994 Kobayashi et al.
5,351,347 A 10/1994 Kunkel
5,351,712 A 10/1994 Houlihan
5,358,177 A 10/1994 Cashmore
5,361,215 A 11/1994 Tompkins et al.
5,362,026 A 11/1994 Kobayashi et al.
5,385,168 A 1/1995 Lund
5,397,099 A 3/1995 Pilolla
5,400,961 A 3/1995 Tsutsui et al.
5,408,578 A 4/1995 Bolivar
5,419,930 A 5/1995 Schucker
5,429,272 A 7/1995 Luigi
5,437,003 A 7/1995 Blanco
RE35,018 E 8/1995 Homan
5,438,642 A 8/1995 Posen
5,467,967 A 11/1995 Gillooly
5,479,558 A 12/1995 White et al.
5,482,250 A 1/1996 Kodaira
5,504,306 A 4/1996 Russell et al.
5,504,950 A 4/1996 Natalizia et al.
5,511,579 A 4/1996 Price
5,511,723 A 4/1996 Eki et al.
5,540,555 A 7/1996 Corso et al.
5,549,273 A 8/1996 Aharon
5,550,753 A 8/1996 Tompkins et al.
5,551,637 A 9/1996 Lo
5,555,912 A 9/1996 Saadi et al.
5,564,462 A 10/1996 Storch
5,566,702 A 10/1996 Philipp
5,570,869 A 11/1996 Diaz et al.
5,572,985 A 11/1996 Benham
5,577,660 A 11/1996 Hansen
5,584,316 A 12/1996 Lund
5,586,572 A 12/1996 Lund
5,588,636 A 12/1996 Eichholz et al.
5,595,216 A 1/1997 Pilolla
5,595,342 A 1/1997 McNair et al.
5,603,344 A 2/1997 Hall
5,609,370 A 3/1997 Szabo et al.
5,610,589 A 3/1997 Evans et al.
5,622,203 A 4/1997 Givler et al.
5,623,990 A 4/1997 Pirkle
5,627,375 A 5/1997 Hsieh
5,650,597 A 7/1997 Redmayne
5,651,384 A 7/1997 Rudrich
5,655,749 A 8/1997 Mauerhofer
5,682,032 A 10/1997 Philipp
5,694,653 A 12/1997 Harald
5,729,422 A 3/1998 Henke
5,730,165 A 3/1998 Philipp
5,735,291 A 4/1998 Kaonohi
5,743,511 A 4/1998 Eichholz et al.
5,755,262 A 5/1998 Pilolla
5,758,688 A 6/1998 Hamanaka et al.
5,758,690 A 6/1998 Humpert et al.
5,769,120 A 6/1998 Laverty et al.
5,771,501 A 6/1998 Shaw
5,775,372 A 7/1998 Houlihan
5,784,531 A 7/1998 Mann et al.
5,790,024 A 8/1998 Ripingill et al.
5,812,059 A 9/1998 Shaw et al.
5,813,655 A 9/1998 Pinchott et al.
5,819,366 A 10/1998 Edin
5,829,467 A 11/1998 Spicher
5,829,475 A 11/1998 Acker
5,845,844 A 12/1998 Zosimodis
5,855,356 A 1/1999 Fait
5,857,717 A 1/1999 Caffrey
5,868,311 A 2/1999 Cretu-Petra
5,872,891 A 2/1999 Son
5,893,387 A 4/1999 Paterson et al.
5,915,417 A 6/1999 Diaz et al.
5,918,855 A 7/1999 Hamanaka et al.
5,934,325 A 8/1999 Brattoli et al.
5,941,275 A 8/1999 Laing
5,941,504 A 8/1999 Toma et al.
5,943,713 A 8/1999 Paterson et al.
5,944,221 A 8/1999 Laing et al.
5,961,095 A 10/1999 Schrott
5,963,624 A 10/1999 Pope
5,966,753 A 10/1999 Gauthier et al.
5,973,417 A 10/1999 Goetz et al.
5,979,776 A 11/1999 Williams
5,983,922 A 11/1999 Laing et al.
5,988,593 A 11/1999 Rice
6,000,170 A 12/1999 Davis
6,003,170 A 12/1999 Humpert et al.
6,003,182 A 12/1999 Song
6,006,784 A 12/1999 Tsutsui et al.
6,019,130 A 2/2000 Rump
6,026,844 A 2/2000 Laing et al.
6,029,094 A 2/2000 Diffut
6,032,616 A 3/2000 Jones
6,042,885 A 3/2000 Woollard et al.
6,059,192 A 5/2000 Zosimadis
6,061,499 A 5/2000 Hlebovy
6,075,454 A 6/2000 Yamasaki
6,082,407 A 7/2000 Paterson et al.
6,101,452 A 8/2000 Krall et al.
6,125,482 A 10/2000 Foster
6,132,085 A 10/2000 Bergeron
6,167,845 B1 1/2001 Decker, Sr.
6,175,689 B1 1/2001 Blanco, Jr.
6,182,683 B1 2/2001 Sisk
6,192,192 B1 2/2001 Illy et al.
6,195,588 B1 2/2001 Gauthier et al.
6,202,980 B1 3/2001 Vincent et al.
6,220,297 B1 4/2001 Marty et al.
6,227,235 B1 5/2001 Laing et al.
6,240,250 B1 5/2001 Blanco, Jr.
6,250,558 B1 6/2001 Dogre Cuevas
6,250,601 B1 6/2001 Kolar et al.
6,273,394 B1 8/2001 Vincent et al.
6,283,139 B1 9/2001 Symonds et al.
6,286,764 B1 9/2001 Garvey et al.
6,288,707 B1 9/2001 Philipp
6,290,139 B1 9/2001 Kolze
6,294,786 B1 9/2001 Marcichow et al.
6,315,208 B1 11/2001 Doyle
6,317,717 B1 11/2001 Lindsey et al.
6,321,785 B1 11/2001 Bergmann
6,337,635 B1 1/2002 Ericksen et al.
6,340,032 B1 1/2002 Zosimadis
6,341,389 B2 1/2002 Philipps-Liebich et al.
6,351,603 B2 2/2002 Waithe et al.
6,363,549 B2 4/2002 Humpert
6,373,265 B1 4/2002 Morimoto et al.
6,377,009 B1 4/2002 Philipp
6,381,770 B1 5/2002 Raisch
6,389,226 B1 5/2002 Neale et al.
6,438,770 B1 8/2002 Hed et al.
6,445,306 B1 9/2002 Trovato et al.
6,446,875 B1 9/2002 Brooks et al.
6,452,514 B1 9/2002 Philipp
RE37,888 E 10/2002 Cretu-Petra
6,457,355 B1 10/2002 Philipp
6,466,036 B1 10/2002 Philipp
6,473,917 B1 11/2002 Mateina
6,474,951 B2 11/2002 Stephan et al.
6,513,787 B1 2/2003 Jeromson et al.
6,522,078 B1 2/2003 Okamoto et al.

(56) References Cited

U.S. PATENT DOCUMENTS 6,535,134 B2 3/2003 Lang et al.
6,535,200 B2 3/2003 Philipp
6,536,464 B1 3/2003 Lum et al.
6,549,816 B2 4/2003 Gauthier et al.
6,574,426 B1 6/2003 Blanco, Jr.
6,588,377 B1 7/2003 Leary et al.
6,588,453 B2 7/2003 Marty et al.
6,612,267 B1 9/2003 West
6,619,320 B2 9/2003 Parsons
6,619,613 B1 * 9/2003 Akamatsu et al. ..... 251/129.04
6,622,930 B2 9/2003 Laing et al.
6,629,645 B2 10/2003 Mountford et al.
6,639,209 B1 10/2003 Patterson et al.
6,644,333 B2 11/2003 Gloodt
6,659,048 B1 12/2003 DeSantis et al.
6,676,024 B1 1/2004 McNerney et al.
6,684,822 B1 2/2004 Lieggi
6,691,338 B2 2/2004 Zieger
6,705,534 B1 3/2004 Mueller
6,707,030 B1 3/2004 Watson
6,734,685 B2 5/2004 Rudrich
6,738,996 B1 5/2004 Malek et al.
6,757,921 B2 7/2004 Esche
6,768,103 B2 7/2004 Watson
6,770,869 B2 8/2004 Patterson et al.
6,779,552 B1 8/2004 Coffman
6,838,887 B2 1/2005 Denen et al.
6,845,526 B2 1/2005 Malek et al.
6,877,172 B2 4/2005 Malek et al.
6,892,952 B2 5/2005 Chang et al.
6,895,985 B2 5/2005 Popper et al.
6,913,203 B2 7/2005 DeLangis
6,955,333 B2 10/2005 Patterson et al.
6,956,498 B1 10/2005 Gauthier et al.
6,962,162 B2 11/2005 Acker
6,962,168 B2 11/2005 McDaniel et al.
6,964,404 B2 11/2005 Patterson et al.
6,964,405 B2 11/2005 Marcichow et al.
6,968,860 B1 11/2005 Haenlein et al.
6,993,607 B2 1/2006 Philipp
6,995,670 B2 2/2006 Wadlow et al.
6,998,545 B2 2/2006 Harkcom et al.
7,006,078 B2 2/2006 Kim
7,014,166 B1 3/2006 Wang
7,015,704 B1 3/2006 Lang
7,025,077 B2 4/2006 Vogel
7,030,860 B1 4/2006 Hsu et al.
7,069,357 B2 6/2006 Marx et al.
7,069,941 B2 7/2006 Parsons et al.
7,083,156 B2 8/2006 Jost et al.
7,096,517 B2 8/2006 Gubeli et al.
7,099,649 B2 8/2006 Patterson et al.
D528,991 S 9/2006 Katsuyama
7,102,366 B2 9/2006 Denen et al.
7,107,631 B2 9/2006 Lang et al.
7,150,293 B2 12/2006 Jonte
7,174,577 B2 2/2007 Jost et al.
7,174,579 B1 2/2007 Bauza
7,228,874 B2 6/2007 Bolderheij et al.
7,232,111 B2 6/2007 McDaniels et al.
7,278,624 B2 10/2007 Iott et al.
7,307,485 B1 12/2007 Snyder et al.
7,537,023 B2 5/2009 Marty et al.
7,537,195 B2 5/2009 McDaniels et al.
7,625,667 B2 12/2009 Marty et al.
7,690,395 B2 4/2010 Jonte et al.
7,766,026 B2 8/2010 Boey
7,784,481 B2 8/2010 Kunkel
7,997,301 B2 8/2011 Marty et al.
8,104,113 B2 1/2012 Rodenbeck et al.
8,127,782 B2 3/2012 Jonte et al.
8,418,993 B2 * 4/2013 Chen ..... 4/623
8,434,172 B2 * 5/2013 Nowak et al. ..... 251/129.04
8,528,579 B2 9/2013 Jonte et al.
8,561,626 B2 10/2013 Sawaski et al.
8,844,564 B2 9/2014 Jonte et al.
8,973,612 B2 3/2015 Sawaski et al.
2001/0011389 A1 8/2001 Philipps-Liebich et al.
2001/0011390 A1 8/2001 Humpert et al.
2001/0011558 A1 8/2001 Schumacher
2001/0011560 A1 8/2001 Pawelzik et al.
2001/0022352 A1 9/2001 Rudrich
2002/0007510 A1 1/2002 Mann
2002/0015024 A1 2/2002 Westerman et al.
2002/0113134 A1 8/2002 Laing et al.
2002/0117122 A1 8/2002 Lindner
2002/0148040 A1 10/2002 Mateina
2002/0175789 A1 11/2002 Pimouguet
2002/0179723 A1 12/2002 Wack et al.
2003/0041374 A1 3/2003 Franke
2003/0080194 A1 5/2003 O'Hara et al.
2003/0088338 A1 5/2003 Phillips et al.
2003/0089399 A1 5/2003 Acker
2003/0125842 A1 7/2003 Chang et al.
2003/0126993 A1 7/2003 Lassota et al.
2003/0185548 A1 10/2003 Novotny et al.
2003/0201018 A1 10/2003 Bush
2003/0213062 A1 11/2003 Honda et al.
2003/0234769 A1 12/2003 Cross et al.
2004/0011399 A1 1/2004 Segien, Jr.
2004/0041033 A1 3/2004 Kemp
2004/0041034 A1 3/2004 Kemp
2004/0041110 A1 3/2004 Kaneko
2004/0061685 A1 4/2004 Ostergard et al.
2004/0088786 A1 5/2004 Malek et al.
2004/0135010 A1 7/2004 Malek et al.
2004/0143898 A1 7/2004 Jost et al.
2004/0144866 A1 7/2004 Nelson et al.
2004/0149643 A1 8/2004 Vandenbelt et al.
2004/0155116 A1 8/2004 Wack et al.
2004/0206405 A1 10/2004 Smith et al.
2004/0212599 A1 10/2004 Cok et al.
2004/0262552 A1 12/2004 Lowe
2005/0001046 A1 1/2005 Laing
2005/0006402 A1 1/2005 Acker
2005/0022871 A1 2/2005 Acker
2005/0044625 A1 3/2005 Kommers
2005/0086958 A1 4/2005 Walsh
2005/0117912 A1 6/2005 Patterson et al.
2005/0121529 A1 6/2005 DeLangis
2005/0125083 A1 6/2005 Kiko
2005/0127313 A1 6/2005 Watson
2005/0146513 A1 7/2005 Hill et al.
2005/0150552 A1 7/2005 Forshey
2005/0150556 A1 7/2005 Jonte
2005/0150557 A1 7/2005 McDaniel et al.
2005/0151101 A1 7/2005 McDaniel et al.
2005/0194399 A1 9/2005 Proctor
2005/0199841 A1 9/2005 O'Maley
2005/0199843 A1 9/2005 Jost et al.
2005/0205818 A1 9/2005 Bayley et al.
2005/0253102 A1 11/2005 Boilen et al.
2005/0273218 A1 12/2005 Breed et al.
2006/0066991 A1 3/2006 Hirano et al.
2006/0101575 A1 5/2006 Louis
2006/0130907 A1 6/2006 Marty et al.
2006/0130908 A1 6/2006 Marty et al.
2006/0138246 A1 6/2006 Stowe et al.
2006/0145111 A1 7/2006 Lang et al.
2006/0153165 A1 7/2006 Beachy
2006/0186215 A1 8/2006 Logan
2006/0200903 A1 9/2006 Rodenbeck et al.
2006/0201558 A1 9/2006 Marty et al.
2006/0202142 A1 9/2006 Marty et al.
2006/0207019 A1 9/2006 Vincent
2006/0212016 A1 9/2006 Lavon et al.
2006/0214016 A1 9/2006 Erdely et al.
2006/0231638 A1 10/2006 Belz et al.
2006/0231782 A1 10/2006 Iott et al.
2006/0231788 A1 10/2006 Cheng
2006/0237674 A1 10/2006 Iott et al.
2006/0283511 A1 12/2006 Nelson
2007/0001018 A1 1/2007 Schmitt et al.
2007/0057215 A1 3/2007 Parsons et al.

(56) References Cited

U.S. PATENT DOCUMENTS

| | | | |
|---|---|---|---|
| 2007/0069168 | A1 | 3/2007 | Jonte |
| 2007/0069169 | A1 | 3/2007 | Lin |
| 2007/0114073 | A1 | 5/2007 | Akel et al. |
| 2007/0138421 | A1 | 6/2007 | Gibson et al. |
| 2007/0156260 | A1 | 7/2007 | Rodenbeck et al. |
| 2007/0157978 | A1 | 7/2007 | Jonte |
| 2007/0187635 | A1 | 8/2007 | Jost |
| 2007/0246267 | A1 | 10/2007 | Koottungal |
| 2007/0246550 | A1 | 10/2007 | Rodenbeck et al. |
| 2007/0246564 | A1 | 10/2007 | Rodenbeck et al. |
| 2008/0078019 | A1 | 4/2008 | Allen et al. |
| 2008/0099088 | A1 | 5/2008 | Boey |
| 2008/0109956 | A1 | 5/2008 | Bayley et al. |
| 2008/0178950 | A1 | 7/2008 | Marty et al. |
| 2008/0271238 | A1 | 11/2008 | Reeder et al. |
| 2008/0289098 | A1 | 11/2008 | Kunkel |
| 2009/0039176 | A1 | 2/2009 | Davidson et al. |
| 2009/0119832 | A1 | 5/2009 | Conroy |
| 2009/0160659 | A1 | 6/2009 | Bailey |
| 2009/0293192 | A1 | 12/2009 | Pons |
| 2010/0044604 | A1 | 2/2010 | Burke et al. |
| 2010/0096017 | A1 | 4/2010 | Jonte et al. |
| 2010/0108165 | A1 | 5/2010 | Rodenbeck et al. |
| 2010/0170570 | A1 | 7/2010 | Rodenbeck et al. |
| 2011/0253220 | A1 | 10/2011 | Sawaski et al. |
| 2012/0055557 | A1 | 3/2012 | Belz et al. |
| 2012/0318364 | A1 | 12/2012 | Sawaski et al. |
| 2013/0186196 | A1 | 7/2013 | Veros et al. |
| 2013/0276911 | A1 | 10/2013 | Meehan et al. |

FOREIGN PATENT DOCUMENTS

| | | | |
|---|---|---|---|
| DE | 04401637 | | 5/1998 |
| DE | 19815324 | | 11/2000 |
| EP | 0961067 | B1 | 12/1999 |
| EP | 1 134 895 | | 9/2001 |
| JP | 63111383 | | 5/1998 |
| JP | 200073426 | | 3/2000 |
| JP | 2003-20703 | A | 1/2003 |
| JP | 2003105817 | | 4/2003 |
| JP | 2003293411 | | 10/2003 |
| JP | 2004-92023 | | 3/2004 |
| JP | 2005-146551 | A | 6/2005 |
| KR | 10-1997-0700266 | | 1/1997 |
| KR | 2003-0077823 | | 10/2003 |
| KR | 20-0382786 | Y1 | 4/2005 |
| WO | WO 91/17377 | | 11/1991 |
| WO | WO 96 14477 | | 5/1996 |
| WO | WO 01/20204 | | 3/2001 |
| WO | WO2004/094990 | | 11/2004 |
| WO | WO 2005/057086 | | 6/2005 |
| WO | WO 2006/098795 | | 9/2006 |
| WO | WO 2006/136256 | | 12/2006 |
| WO | WO 2007/059051 | | 5/2007 |
| WO | WO 2007/124311 | | 11/2007 |
| WO | WO 2007/124438 | | 11/2007 |
| WO | WO 2008/088534 | | 7/2008 |
| WO | WO 2008/094247 | | 8/2008 |
| WO | WO 2008/094651 | | 8/2008 |
| WO | WO 2008/118402 | | 10/2008 |
| WO | WO 2009/075858 | | 6/2009 |

OTHER PUBLICATIONS

Dallmer Manutronic brochure, "The First Electronic mixer-taps that your hands can orchestrate," Dallmer Handel GmbH, at least as early as Jan. 31, 2008, 12 pgs.

Hego WaterDesign, "Touch Faucets—Amazing Futuristic Faucet Designs," Oct. 6, 2009, 3 pgs.

International Search Report and Written Opinion for PCT/US2007/025336, 5 pages, Sep. 2008.

International Search Report and Written Opinion for PCT/US2007/67116, 9 pages, Aug. 2008.

KWC AG, Kitchen Faucet 802285 Installation and Service Instructions, dated Jul. 2005, 8 pgs.

Philipp, Hal, "Tough Touch Screen," applicanceDESIGN, Feb. 2006.

Quantum Research Group, "E401 User Manual," at least as early as Oct. 22, 2007, 15 pgs.

Quantum Research Group, "Gorenje Puts QSlide™ Technology into Next-Generation Kitchen Hob," Feb. 8, 2006, http://www.qprox.com/news/gorenje.php, 3 pgs.

Quantum Research Group, "Qprox™ Capacitive Touch Applications," © 2005, http://www.qprox.com/background/applications.php, 8 pgs.

Quantum Research Group, "QT401 QSlide™ Touch Slider IC," 2004, 16 pgs.

Quantum Research Group, "QT411-ISSG QSlide™ Touch Slider IC," 2004-2005, 12 pgs.

Sequine et al., Cypress Perform, "Application Notes AN2233a," Apr. 14, 2005, 6 pgs.

Sequine et al., Cypress Perform, "Application Notes AN2292," Oct. 31, 2005, 15 pgs.

SLOAN® Optima® i.q. Electronic Hand Washing Faucet, Apr. 2004, 2 pgs.

Symmons, Ultra-Sense, Battery-Powered Faucets with PDS and Ultra-Sense AC Powered Faucets, © 1999-2004, 2 pgs.

Symmons, Ultra-Sense®, Sensor Faucet with Position-Sensitive Detection, © 2001-2002, 2 pgs.

Symmons® Commercial Faucets: Reliability With a Sense of Style, at least as early as Jan. 4, 2006, 1 pg.

Symmons®, "Ultra-Sense® Battery-Powered, Sensor-Operated Lavatory Faucet S-6080 Series," Oct. 2002, 4 pgs.

Symmons®, "Ultra-Sense® Sensor Faucets with Position-Sensitive Detection," Aug. 2004, 4 pgs.

Technical Concepts International, Inc., Capri AutoFaucet® with Surround Sensor™ Technology, 500556, 500576, 500577, at least as early as May 1, 2006, 1 pg.

Technical Concepts, AutoFaucet® with "Surround Sensor" Technology, Oct. 2005, 4 pgs.

TOTO® Products, "Self-Generating EcoPower System Sensor Faucet, Standard Spout," Specification Sheet, Nov. 2002, 2 pgs.

Various Products (available at least before Apr. 20, 2006), 5 pgs.

Villeroy & Boch "Magic Faucet," at least as early as Nov. 2009, 2 pgs.

Villeroy & Boch web pages, "Magic Basin," 2 pgs., downloaded from http://www.villeroy-boch.com on Dec. 27, 2006.

ZURN® Plumbing Products Group, "AquaSense® Sensor Faucet," Jun. 9, 2004, 2 pgs.

ZURN® Plumbing Products Group, "AquaSense® Z6903 Series", Installation, Operation, Maintenance and Parts Manual, Aug. 2001, 5 pgs.

* cited by examiner

MULTI-MODE HANDS FREE AUTOMATIC FAUCET

CROSS-REFERENCE TO RELATED APPLICATION

This application is a continuation of U.S. patent application Ser. No. 12/648,486, filed Dec. 29, 2009, now U.S. Pat. No. 8,528,579, which is a divisional of U.S. patent application Ser. No. 11/641,574, filed Dec. 19, 2006, now U.S. Pat. No. 7,690,395, which is a continuation-in-part of U.S. patent application Ser. No. 10/755,581, filed Jan. 12, 2004, now U.S. Pat. No. 7,150,293, and a continuation-in-part of U.S. patent application Ser. No. 11/325,128, filed Jan. 4, 2006, now U.S. Pat. No. 7,997,301, which claims the benefit of and priority to U.S. Provisional Patent Application Ser. No. 60/662,107, filed Mar. 14, 2005, the disclosures of which are all expressly incorporated herein by reference.

BACKGROUND OF THE INVENTION

1. Field of the Invention

The present invention generally relates to the field of automatic faucets. More particularly, the present invention relates to an automatic faucet that uses both proximity and contact sensors in conjunction with logic that responds to various actions to provide easy and intuitive operation.

2. Description of the Related Art

Automatic faucets have become popular for a variety of reasons. They save water, because water can be run only when needed. For example, with a conventional sink faucet, when a user washes their hands the user tends to turn on the water and let it run continuously, rather than turning the water on to wet their hands, turning it off to lather, then turning it back on to rinse. In public bathrooms the ability to shut off the water when the user has departed can both save water and help prevent vandalism.

One early version of an automatic faucet was simply a spring-controlled faucet, which returned to the "off" position either immediately, or shortly after, the handle was released. The former were unsatisfactory because a user could only wash one hand at a time, while the later proved to be mechanically unreliable.

A better solution was hands-free faucets. These faucets employ a proximity detector and an electric power source to activate water flow, and so can be operated without a handle. In addition to helping to conserve water and prevent vandalism, hands-free faucets also had additional advantages, some of which began to make them popular in homes, as well as public bathrooms. For example, there is no need to touch the faucet to activate it; with a conventional faucet, a user with dirty hands may need to wash the faucet after washing their hands. Non-contact operation is also more sanitary, especially in public facilities. Hands-free faucets also provide superior accessibility for the disabled, or for the elderly, or those who need assisted care.

Typically, these faucets use proximity detectors, such as active infrared ("IR") detectors in the form of photodiode pairs, to detect the user's hands (or other objects positioned in the sink for washing). Pulses of IR light are emitted by one diode with the other being used to detect reflections of the emitted light off an object in front of the faucet. Different designs use different locations on the spout for the photodiodes, including placing them at the head of the spout, farther down the spout near its base, or even at positions entirely separate from the spout. Likewise, different designs use different physical mechanisms for detecting the proximity of objects, such as ultrasonic signals or changes in the magnetic permeability near the faucet.

Examples of a hands-free faucets are given in U.S. Pat. No. 5,566,702 to Philippe, and U.S. Pat. No. 6,273,394 to Vincent, and U.S. Pat. No. 6,363,549 to Humpert, which are hereby incorporated herein in their entireties.

Although hands-free faucets have many advantages, depending on how they are used, some tasks may best be accomplished with direct control over the starting and stopping of the flow of water. For example, if the user wishes to fill the basin with water to wash something the hands-free faucet could be frustrating, since it would require the user to keep their hand continuously in the detection zone of the sensors. This is especially likely with a kitchen sink faucet, which may be used in many different tasks, such as washing dishes and utensils. Due to its size, the kitchen sink is often the preferred sink for filling buckets, pots, etc. Thus, there is a need for a kitchen faucet that provides water savings, but which does not interfere with other tasks in which a continuous flow is desired.

Each of these control methods has advantages for a particular intended task. Thus, what is needed is a faucet that provides both conventional, touch control, and hands-free operation modes, so that a user can employ the control mode that is best suited to the task at hand. The present invention is directed towards meeting this need, among others.

SUMMARY OF THE INVENTION

In an illustrative embodiment, the present invention provides a hands-free faucet comprising a proximity sensor, a handle, and a logical control. The logical control comprises a manual mode, wherein the proximity sensor is inactive, and wherein positioning the handle toggles water flow on and off. This logical control also comprises a hands-free mode, wherein water flow is toggled on and off in response to the proximity sensor. The mode-controller toggles the faucet between the hands-free mode and the manual mode. The handle comprises a touch control, the touch control controlling activation of water flow through the faucet in response to contact of a user with the handle that is insufficient to change a position of the handle.

In a further illustrative embodiment, the present invention provides a hands-free faucet comprising a proximity sensor and a logical control. The logical control comprises a manual mode, wherein the proximity sensor is inactive, and water flow is toggled on and off by positioning the handle; a hands-free mode, wherein water flow is toggled on and off in response to the proximity sensor; and a handle. The handle comprises a first touch control that puts the faucet in the hands-free mode when touched by a user; a second touch control that toggles the faucet between the hands-free mode and the manual mode when touched by a user; and a mode indicator that displays which mode the faucet is presently in. The water flow has a temperature and flow rate that is determined by the position of the handle.

In another illustrative embodiment, the present invention provides a hands-free kitchen-type faucet.

In a further illustrative embodiment, the present invention provides a kitchen-type faucet having a touch control that controls activation of water flow through the faucet in response to contact of a user with a handle, where the contact is insufficient to change a position of the handle.

In yet another illustrative embodiment, the present invention provides a hands-free faucet comprising a manual valve; an electrically operable valve in series with the manual valve;

and a logical control comprising a manual mode and a hands-free mode, the logical control causing the electrically operable valve to open and close. The faucet enters the manual mode when the faucet detects that water is not flowing through the faucet and the electrically operable valve is open.

In a further illustrative embodiment, the present invention provides a faucet comprising a pull-down spout, wherein pulling out the pull-down spout activates water flow.

In another illustrative embodiment, a faucet includes a spout, a handle, and a touch control operably coupled to at least one of the spout and the handle. A proximity sensor is provided and includes an active and an inactive state. A logical control is operably coupled to the touch control and the proximity sensor. The logical control includes a first mode, wherein the proximity sensor is inactive, and a second mode, wherein the proximity sensor is active. A mode indicator is configured to provide a visual indication of at least one of the first mode and the second mode.

According to a further illustrative embodiment, a faucet includes a spout, a handle, and a touch control operably coupled to at least one of the spout and the handle. A proximity sensor is provided and includes an active state and an inactive state. A logical control is operably coupled to the touch control and the proximity sensor. The logical control includes a first mode, wherein the proximity sensor is inactive, and a second mode, wherein the proximity sensor is active. The logical control further includes a mode controller that changes the faucet between the first mode and the second mode and responds to substantially simultaneous touching of the spout and the handle.

In a further illustrative embodiment, a faucet includes a spout, a handle, a touch control operably coupled to at least one of the spout and the handle, and a proximity sensor having an active state and an inactive state. A logical control is operably coupled to the touch control and the proximity sensor. The logical control includes a first mode, wherein the proximity sensor is inactive, and a second mode wherein the proximity sensor is active. An audio device is configured to provide an audible indication of transition between the first mode and the second mode.

In another embodiment of the present invention, a capacitive sensor is provided for use with a single hole mount faucet. In single hole mount faucets, the spout and manual valve handle are coupled to a faucet body hub which is connected to a single mounting hole. The capacitive sensor may be either coupled to a new faucet or retrofit onto an existing faucet without impacting the industrial design or requiring redesign of the faucet.

In an illustrated embodiment, a capacitive sensor is electrically connected to the faucet body hub. The handle of the manual control valve is electrically coupled to the faucet body hub due to metal-to-metal contact between the handle and the hub. However, the spout is coupled to the faucet body hub with an insulator. Therefore, the spout is capacitively coupled to the faucet body hub. A larger capacitance difference is detected when the handle is grasped by a user compared to when the spout is grasped. Therefore, a controller can determine where a user is touching the faucet (i.e., the handle or the spout) and for how long in order to control operation of the faucet in different modes.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying figures forming a part hereof.

DETAILED DESCRIPTION OF THE PREFERRED EMBODIMENT

For the purposes of promoting an understanding of the principles of the invention, reference will now be made to the preferred embodiment and specific language will be used to describe the same. It will nevertheless be understood that no limitation of the scope of the invention is thereby intended. Such alternations and further modifications in the invention, and such further applications of the principles of the invention as described herein as would normally occur to one skilled in the art to which the invention pertains, are contemplated, and desired to be protected.

An illustrative embodiment of the present invention provides a kitchen-type faucet that can be placed in at least two modes, in order to provide water-efficient operation that is easy and convenient to use. In a hands-free mode, the water is activated and deactivated in response to a proximity sensor that detects when something is presently under the spout, so as to provide the most water-efficient operation, while still maintaining easy and convenient operation and use. For other applications, such as filling the sink to wash dishes, or filling pots, bottles, or other such items, the faucet can be operated in manual mode, wherein the water is controlled by a manual handle as with a conventional faucet. When the faucet is manually closed and not in use, the faucet is returned to manual mode, and the proximity detector is deactivated, so that power consumption is limited, making it practical to power the faucet with batteries.

Figure 1:
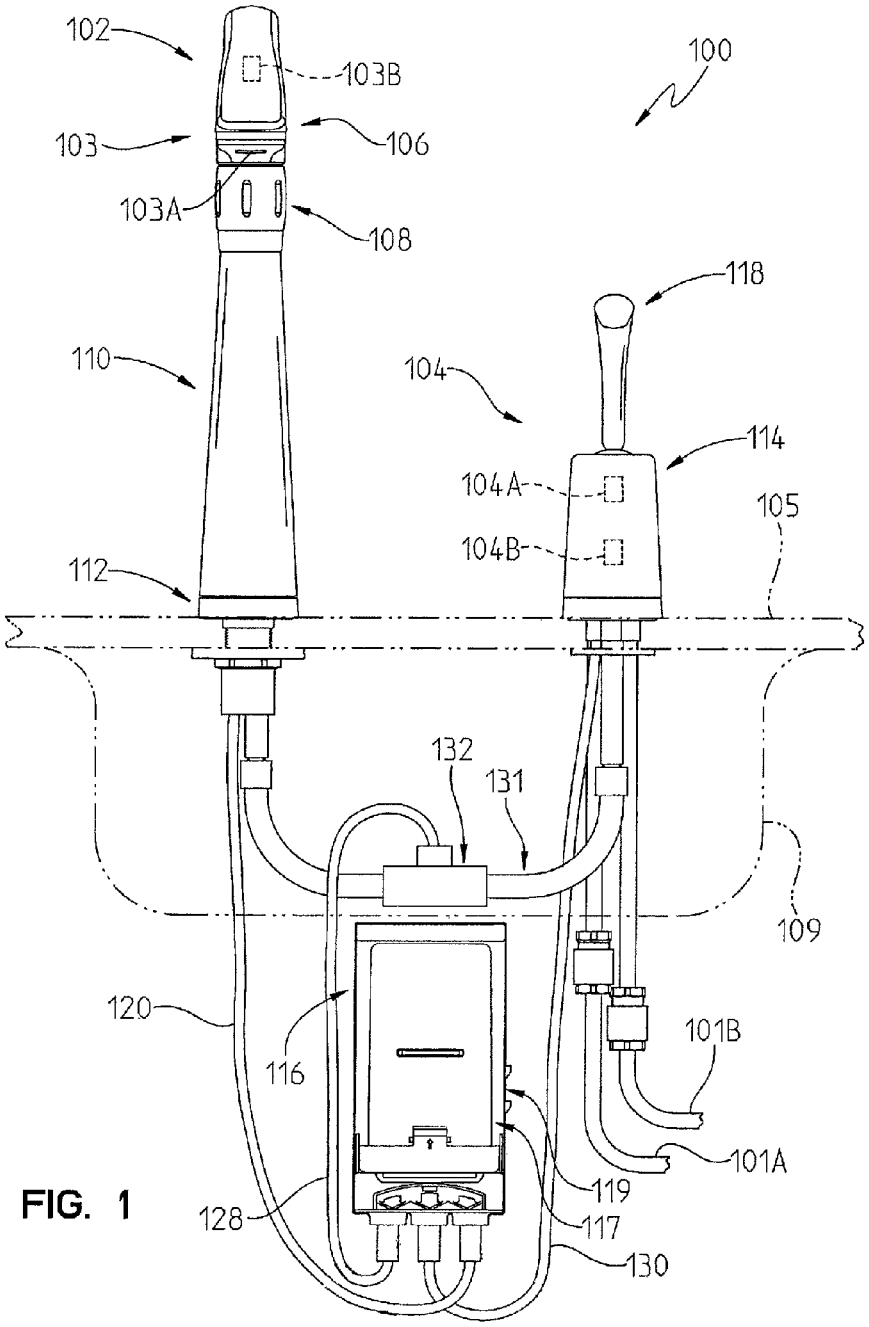
FIG. 1 is a front plan view of an illustrative embodiment electronic faucet system including a valve body assembly having an electrical cable extending therefrom to a controller assembly, and a spout assembly having an electrical cable extending therefrom to the controller assembly.

FIG. 1 is a perspective view of an illustrative embodiment kitchen-type faucet according to the present invention, indicated generally at 100. It will be appreciated that kitchen-type faucets and lavatory-type faucets are distinguished by a variety of features, such as the size of their spouts, the ability of the spout to swivel, and, often, the manual control. These features are related to the different applications for which they are used. Kitchen-type faucets are generally used for longer periods, and for washing and filling a variety of objects, while lavatory-type faucets are used mostly to wash the user's hands and face. Kitchen-type faucets typically have longer and higher spouts, in order to facilitate placing objects, such as dishes, pots, buckets, etc., under them. Kitchen-type faucets typically rise at least 6 inches above the deck of the sink, and may rise more than a foot. In addition, kitchen-type faucets typically swivel in the horizontal plane, so that they can be directed into either of the pair of basins in a typical kitchen sink. Lavatory-type faucets, on the other hand, are usually fixed, since even bathrooms with more than one sink basin are typically fitted with a separate faucet for each. In addition, kitchen-type faucets are generally controlled by a single manual handle that controls both the hot and cold water supplies, because it makes it easier to operate while one hand is holding something. Lavatory-type faucets more often have separate hot and cold water handles, in part for aesthetic reasons. Although there are exceptions to each of these general rules, in practice kitchen-type faucets and lavatory-type faucets are easily distinguished by users.

While the present invention's multi-mode operation is especially useful for kitchen sinks, the present invention may also be used with a lavatory-type faucet.

An illustrative embodiment faucet according to the present invention comprises a manually controlled valve in series with an actuator driven valve, illustratively a magnetically latching pilot-controlled solenoid valve. Thus, when the solenoid valve is open the faucet can be operated in a conventional manner, in a manual control mode. Conversely, when the manually controlled valve is set to select a water temperature and flow rate the solenoid valve can be touch controlled, or activated by proximity sensors when an object (such as a user's hands) is within a detection zone to toggle water flow on and off. An advantageous configuration for a proximity detector and logical control for the faucet in response to the proximity detector is described in greater detail in U.S. patent application Ser. No. 10/755,582, filed Jan. 12, 2004, entitled "Control Arrangement for an Automatic Residential Faucet," which is hereby incorporated in its entirety.

It will be appreciated that a proximity sensor is any type of device that senses proximity of objects, including, for example, typical infrared or ultrasound sensors known in the art. Touch or contact sensors, in contrast, sense contact of objects.

Magnetically latching solenoids comprise at least one permanent magnet. When the armature is unseated, it is sufficiently distant from the at least one permanent magnet that it applies little force to the armature. However, when a pulse of power is applied to the solenoid coil the armature is moved to the latched position, sufficiently close to the at least one permanent magnet that the armature is held in place. The armature remains seated in the latched position until a pulse of power is applied to the solenoid coil that generates a relatively strong opposing magnetic field, which neutralizes the latching magnetic field and allows a spring to drive the armature back to the unlatched position. Thus, a magnetically latching solenoid, unlike typical solenoids, does not require power to hold the armature in either position, but does require power to actuate the armature in both directions. While the preferred embodiment employs a magnetically latching solenoid valve, it will be appreciated that any suitable electrically operable valve can be used in series with the manual valve. For example, any type of solenoid valve can be used.

Illustratively, the electrically operable valve is relatively slow-opening and -closing, in order to reduce pressure spikes, known as "water hammer," and undesirable splashing. On the other hand, the valve should not open or close so slowly as to be irritating to the user. It has been determined that a valve opening or closing period of at least 0.5 seconds sufficiently suppresses water hammer and splashing.

Figure 2:
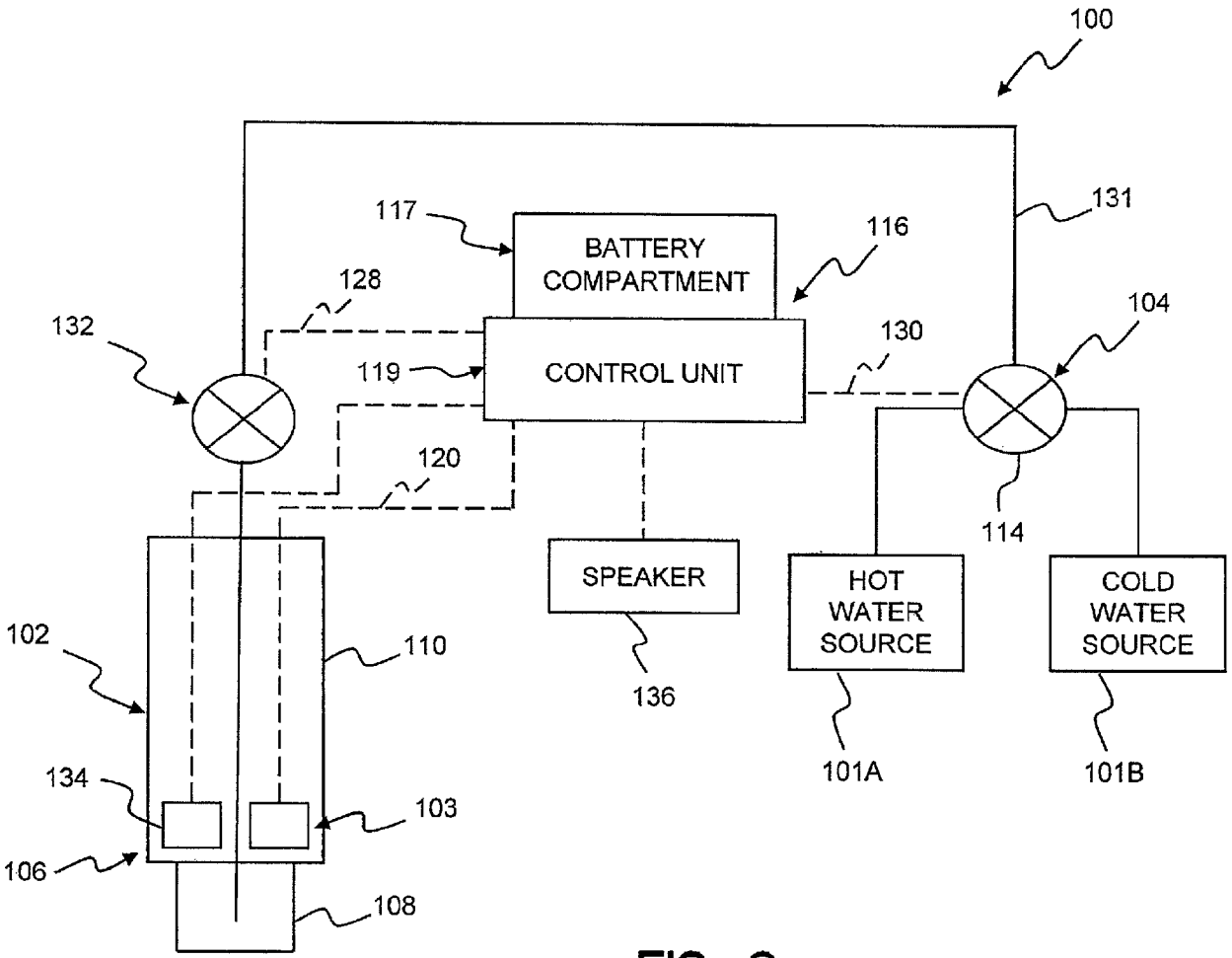
FIG. 2 is a block diagram illustrating the electronic faucet system of FIG. 1.
Figure 3:
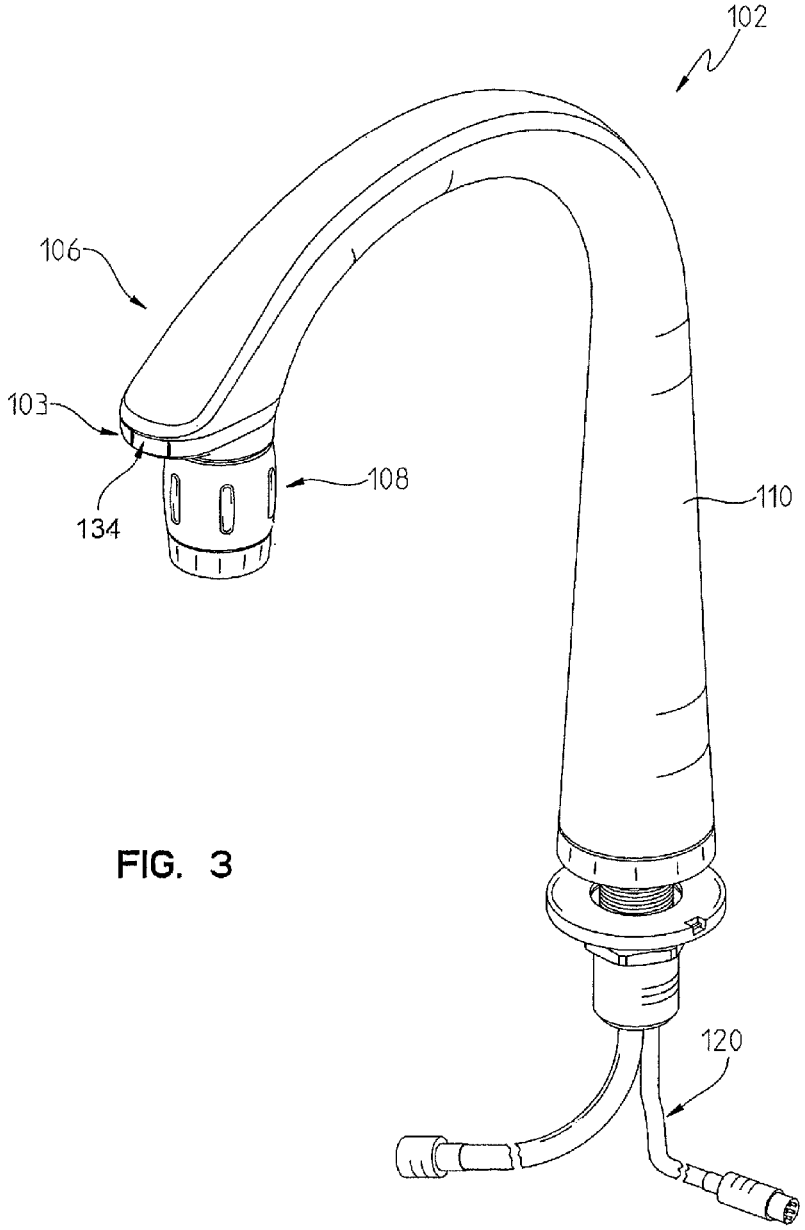
FIG. 3 is a top, front side perspective view of the spout assembly of FIG. 1.

Referring initially to FIGS. 1 and 2, an illustrative electronic faucet system 100 is shown fluidly coupled to a hot water source 101A and a cold water source 101B. Faucet system 100 includes a spout assembly 102 and a valve body assembly 104 mounted to a sink deck 105. As explained in more detail herein and in U.S. patent application Ser. No. 11/326,989, filed Jan. 5, 2006, entitled "Position-Sensing Detector Arrangement For Controlling A Faucet," the disclosure of which is expressly incorporated by reference herein, spout assembly 102 illustratively includes several electronic sensors. More particularly, spout assembly 102 illustratively includes a sensor assembly 103 having an infrared sensor 103A generally in an upper portion 106 of spout assembly 102 to detect the presence of an object, such as a user's hands. Sensor assembly 103 further illustratively includes a Hall effect sensor positioned in upper portion 106 to detect when a pull-out or pull-down spray head 108 is spaced apart from upper portion 106, for example when a user is directing water flow to desired objects within a sink basin 109. Sensor assembly 103 additionally illustratively includes a touch control, such as a capacitance touch sensor 103B wherein fluid flow from spout assembly 102 may be activated by the user touching spout assembly 102. Additional sensors or electronic devices may be positioned within or attached to spout assembly 102.

Due to the presence of electronics (such as the described sensors) generally within upper portion 106, a spout control electrical cable 120 is contained within a delivery spout 110 of spout assembly 102 and provides electrical communication between sensor assembly 103 and a controller 116. Illustratively, controller 116 includes a battery compartment 117 operably coupled to a logical control unit 119. Additional details of the controller 116 are provided in one or more of the Related Applications, including U.S. patent application Ser. No. 11/324,901, filed Jan. 4, 2006, entitled "Battery Box Assembly," the disclosure of which is expressly incorporated by reference herein.

Valve body assembly 104 also illustratively includes several sensors as explained in more detail in one or more of the Related Applications including U.S. patent application Ser. No. 11/326,986, filed Jan. 5, 2006, entitled "Valve Body Assembly With Electronic Switching," the disclosure of which is expressly incorporated by reference herein. Valve body assembly 104 illustratively includes a conventional manual valve member (such as a mixing ball or disc) to provide for the manual control of the flow and temperature of water in response to manual manipulation of a handle 118 supported for movement relative to a holder 114. A Hall effect sensor 104A is illustratively positioned in holder 114 to detect a position of the manual valve member, and hence, the handle 118. Valve body assembly 104 further illustratively includes a capacitance touch sensor 104B wherein fluid flow from spout assembly 102 may be activated by the user touching valve body assembly 104. Additional sensors or electronic devices may be positioned within or attached to valve body assembly 104. Due to the presence of electronics (such as the described sensors) generally within holder 114, a valve control electrical cable 130 is contained within holder 114 and provides electrical communication with controller 116.

With further reference to FIG. 2, the faucet system 100 is in fluid communication with hot water source 101A and cold water source 101B. The valve body assembly 104 illustratively mixes hot water from the hot water source 101 and cold water from the cold water source 101 to supply a mixed water to an actuator driven valve 132 through a mixed water conduit 131. Illustratively, the actuator driven valve 132 comprises a conventional magnetically latching solenoid valve of the type available from R.P.E. of Italy. The actuator driven valve 132 is controlled by the controller 116 through an electrical cable 128 and, as such, controls the flow of mixed water supplied to the spout assembly 102. As shown in FIGS. 1 and 2, the valves 104 and 132 are arranged in series and are fluidly coupled by mixed water conduit 131. The spout assembly 102 is configured to dispense mixed water through spray head 108 and into conventional sink basin 109.

As shown in FIGS. 1 and 2, when the actuator driven valve 132 is open, the faucet system 100 may be operated in a conventional manner, i.e., in a manual control mode through operation of the handle 118 and the manual valve member of valve body assembly 104. Conversely, when the manually controlled valve body assembly 104 is set to select a water temperature and flow rate, the actuator driven valve 132 can be touch controlled, or activated by proximity sensors when an object (such as a user's hands) are within a detection zone to toggle water flow on and off.

In an illustrative embodiment, the actuator driven valve 132 is controlled by electronic circuitry within control unit 119 that implements logical control of the faucet assembly 100. This logical control includes at least two functional modes: a manual mode, wherein the actuator driven valve 132 remains open, and a hands-free mode, wherein the actuator driven valve 132 is toggled in response to signals from a proximity sensor. Thus, in the manual mode, the faucet assembly 100 is controlled by the position of the handle 118 in a manner similar to a conventional faucet, while in the hands-free mode, the flow is toggled on and off in response to the proximity sensor (while the flow temperature and rate are still controlled by the handle 118 position). The logical control may also include a further functional mode: a touch mode such that tapping of one of the handle 118 and the spout 110 toggles water flow on and off. As further detailed herein, tapping is illustratively defined as a touch by a user having a duration of less than approximately 250 milliseconds and greater than approximately 50 milliseconds. Grasping, in turn, is defined as a user touch having a duration of more than approximately 250 milliseconds. In one illustrative embodiment of the touch mode, tapping either the handle 118 and the spout 110 or a grasping of the handle 118 activates actuator driven valve 132, while grasping the spout 110 alone has no effect.

Illustratively, the faucet assembly 100 is set to operate in a hands-free mode by user interaction, for example by input from a push-button, by input from a strain gauge or a piezoelectric sensor incorporated into a portion of the faucet assembly 100, such as the spout assembly 102, or by input from a capacitive touch button or other capacitive touch detector. It will be appreciated that a touch control, whether implemented with a strain gauge or a capacitive touch-sensor can respond to contact between a user and the handle 118 that is insufficient to change a position of the handle 118.

The capacitive touch control 103B may be incorporated into the spout assembly 102 of the faucet assembly 100, as taught by U.S. Pat. No. 6,962,168, entitled "Capacitive Touch On/Off Control For An Automatic Residential Faucet," the disclosure of which is expressly incorporated by reference herein. In certain illustrative embodiments, the same mode-selector can be used to return the faucet assembly 100 from hands-free mode to manual mode. In certain of these illustrative embodiments, as detailed herein, a touch-sensor 104B is also incorporated into the handle 118. In such illustrative embodiments, the two touch controls can either operate independently (i.e. mode can be changed by touching either one of the touch controls), or together, so that the mode is changed only when both touch controls are simultaneously touched.

More particularly, in one illustrative embodiment, the mode of the logical control may be changed by simultaneously grasping the spout 110 and tapping the handle 118. In the illustrative embodiment, the mode is toggled from hands free on (i.e., proximity sensor active) to hands free off (i.e., proximity sensor inactive) by simultaneously grasping the spout 110 and tapping the handle 118 twice in order to reduce inadvertent mode changes. As detailed above, grasping is defined by a user contact lasting longer than approximately 250 milliseconds, while tapping is defined as user contact lasting less than approximately 250 milliseconds. As such, the threshold value of 250 milliseconds permits the logical control to distinguish between these two types of contact with a user.

In certain alternative embodiments, once placed in hands-free mode the faucet assembly 100 can be returned to manual mode simply by returning the manual faucet control handle 118 to a closed position. In addition, in certain illustrative embodiments the faucet assembly 100 returns to manual mode after some period of time, such as 20 minutes, without user intervention. This time-out feature may be useful for applications in which power is supplied by batteries, because it preserves battery life. In one illustrative embodiment, once the hands-free mode is activated, the actuator driven valve 132 is closed, stopping the water flow. This state is the hands-free standby state, in which water flow will be activated by a proximity detector. The manual valve handle 118 preferably remains in the open position. In other words, the manual valve body assembly 104 remains open, so that flow is halted only by the actuator driven valve 132.

In the hands-free standby state, objects positioned within the sensor's trigger zone cause the faucet assembly 100 to enter the hands-free active state, wherein the actuator driven valve 132 is opened, thus permitting the water to flow. The faucet assembly 100 remains in hands-free active mode, and the actuator driven valve 132 remains open, as long as objects are detected within the sensor's trigger zone. When objects are no longer detected in the sensor's trigger zone, the faucet assembly 100 returns to hands-free standby mode, and the actuator driven valve 132 closes.

It will be appreciated that water flow is important while a user is attempting to adjust the flow rate or temperature. More particularly, the user observes these properties as they are adjusted, in effect completing a feedback loop. Thus, adjustment of the flow properties is another case in which water flow is preferably activated without requiring the user to place his or her hands or an object in the trigger zone. Therefore, in the illustrative embodiment, when the faucet assembly 100 is in standby hands-free mode, the faucet assembly 100 switches to active hands-free mode, and the actuator driven valve 132 is opened, whenever the manual control handle 118 is touched.

In certain alternative embodiments, when the handle 118 is touched while in hands-free mode, the faucet assembly 100 switches to manual mode, which will, of course, also result in activating the water flow (unless the handle is closed), as well as the deactivation of the proximity sensor. If the user wishes to then return to hands-free mode, he or she may reactivate it in the usual way, such as by a touch control.

In the illustrative embodiment, the faucet assembly 100 does not immediately enter the hands-free mode when the manual valve body assembly 104 is opened and released. Instead, the faucet assembly 100 enters a "quasi-hands-free" state, in which the faucet assembly 100 continues to be manually controlled, and the actuator driven valve 132 remains open. This quasi-hands-free state persists as long as the proximity sensor does not detect the presence of an object within the sensor's trigger zone. This allows the faucet assembly 100 to function as a normal manual valve when initially operated, but to switch modes to hands-free automatically when sensing the presence of an object within the trigger zone. The advantage of this quasi-hands-free mode is that the faucet assembly 100 can be operated as a conventional manual faucet without the necessity of manually selecting the manual mode. This is valuable, for example, in single-use activations such as getting a glass of water or when guests use the faucet assembly 100. In these embodiments, when the user initially opens the faucet assembly 100 and adjusts the water temperature or flow rate and then releases the handle 118, the water does not immediately shut off, thereby frustrating the user's attempt to operate the faucet assembly 100 as a manual faucet. After the user has adjusted the flow, and places an object within the faucet assembly's detection zone, the faucet assembly 100 will then enter hands-free mode.

Because the behavior of the faucet assembly 100 in response to its various input devices is a function of the mode it is presently in, illustratively, the faucet assembly 100 includes some type of low-power mode indicator 134 to identify it's current mode. Appropriate indicators include LEDs (light emitting diodes), LCDs (liquid crystal displays), or a magnetically latching mechanical indicator. In certain embodiments, the mode indicator 134 may simply be a single bit indicator (such as a single LED) that is activated when the faucet assembly 100 is in hands-free mode. Alternatively, the mode indicator 134 may include a separate bit display for each possible mode. In still other embodiments, the mode indicator 134 may indicate mode in some other way, such as a multi-color LED, in which one color indicates hands-free mode, and one or more other colors indicate other modes. Further, and as detailed herein, transition between modes may illustratively be indicated by an audio output.

Illustratively, the mode indicator 134 comprises a reflector cooperating with a light pipe (not shown) which is configured to assist in directing light from an LED to a forward projecting lens in the manner detailed U.S. patent application Ser. No. 11/325,128, filed Jan. 4, 2006, entitled "Spout Assembly For An Electronic Faucet," which has been incorporated by reference herein. The mode indicator 134 is operably coupled to the logical control 119. The logical control 119 provides several different operational states for the mode indicator 134. In a first operational state, which is illustratively the default state, the mode indicator 134 provides a blue light to indicate that the proximity sensor is active thereby providing hands free operation, and provides a red light to indicate a low battery condition. In a second operational state, which is a hands-free flash state, the mode indicator 134 provides a flashing blue light when the proximity sensor is active, provides a solid blue light when water is running due to hands free activation, and provides a magenta color when water is flowing due to touch activation. In a third operational state, all mode indicator functions are disabled, with the exception of a red light to indicate low battery. In a fourth operational state, which is a debug state, the mode indicator 134 provides a solid blue light when the proximity sensor is active, provides a flashing magenta color when a spout touch is sensed, provides a solid magenta color when a valve touch is sensed, provides a solid red color when the actuator driven valve 132 is activated, and provides a flashing red light when the pull down sensor, as described herein, is activated. In a fifth operational state, which is a show room state, the mode indicator 134 provides a solid blue light whenever water should be flowing.

As noted above, an audio output may be provided to indicate transition between modes. More particularly, an audio device, illustratively a speaker 136, is operably coupled to the logical control 119 and is configured to provide an audible indication of transition between modes. In one illustrative embodiment, the speaker 136 provides an ascending tone when the logical control 119 transitions from a hands free off mode (i.e., proximity sensor is inactive) to a hands free on mode (i.e., proximity sensor is active). Similarly, the audio speaker 136 provides a descending tone when the logical control 119 transitions from the hands free on mode to the hands free off mode.

The speaker 136 may also provide audible indications for other system conditions. For example, the speaker 136 may provide an audible tone for a low battery condition. The speaker 136 may also provide a distinct tone upon initial start up of the system.

When a user is finished using the faucet assembly 100, the faucet assembly 100 is illustratively powered down and returned to a baseline state. Powering down provides power savings, which makes it more feasible to operate the faucet assembly 100 from battery power. Returning the faucet assembly 100 to a baseline state is helpful because it gives predictable behavior when the user first begins using the faucet assembly 100 in a particular period of operation. Preferably, the baseline state is the manual mode, since the next user of the faucet assembly 100 might not be familiar with the hands-free operation. Illustratively, a user is able to power down the faucet assembly 100 and return it to the manual, baseline mode simply by returning the manual handle 118 to the closed position, because this is a reflexive and intuitive action for users.

As a consequence, the illustrative embodiment faucet assembly 100 is configured to sense whether the handle 118 is in the closed position. It will be appreciated that this can be accomplished directly, via a sensor in the valve body assembly 104 that detects when the manual valve member is closed, such as by including a small magnet in the handle 118, and an appropriately positioned Hall effect sensor. Alternatively, the handle position can be observed indirectly, for example by measuring water pressure above and below the manual valve, or with a commercial flow sensor. However, it will be appreciated that this inference (that the handle 118 is in a closed position) is only valid if the electrically operable valve is open. It will be appreciated that, because the actuator driven valve 132 is controlled electronically, this is easily tracked by the controller 116. Thus, in the illustrative embodiment, the faucet assembly 100 is returned to manual mode when both the actuator driven valve 132 is open and water is not flowing through the faucet assembly 100.

Illustratively, the faucet assembly 100 also includes a "watchdog" timer, which automatically closes the actuator driven valve 132 after a certain period of time, in order to prevent overflowing or flooding. In certain of these illustrative embodiments, normal operation is resumed once an object is no longer detected in the sensor's trigger zone. In certain other illustrative embodiments, normal operation is resumed once the manual valve body assembly 104 is closed. In still other illustrative embodiments, normal operation is resumed in either event. In those illustrative embodiments including a hands-free mode indicator 134, the indicator is flashed, or otherwise controlled to indicate the time-out condition.

In addition to the various power-saving measures described above, the illustrative embodiment also includes an output mechanism that alerts users when batter power is low. It will be appreciated that any suitable output mechanism may be used, but illustratively mode indicator 134 and audio speaker 136 are used.

Figure 4A:
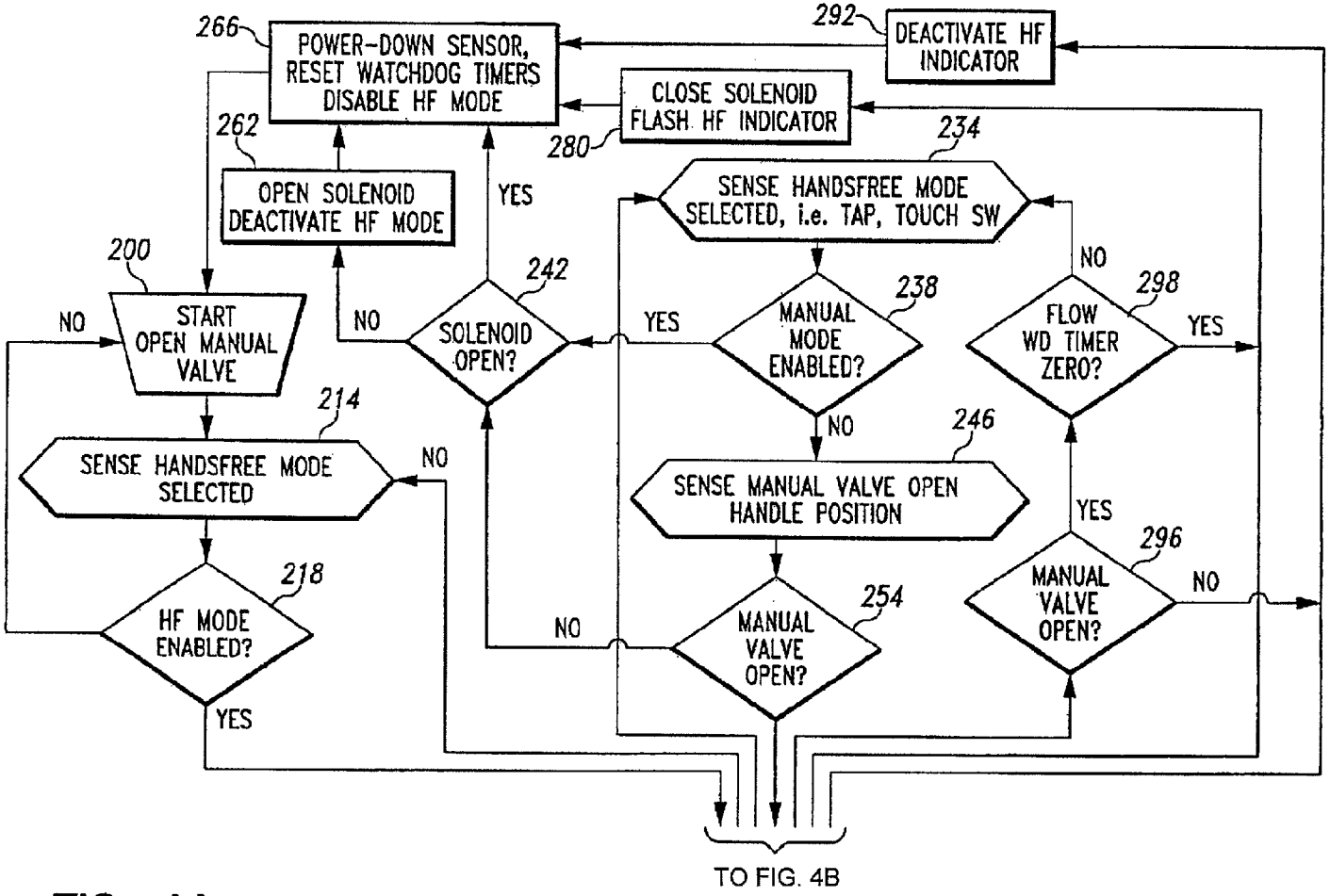
FIGS. 4A and 4B are diagrams of a logical control for an illustrative embodiment faucet according to the present invention.
Figure 4B:
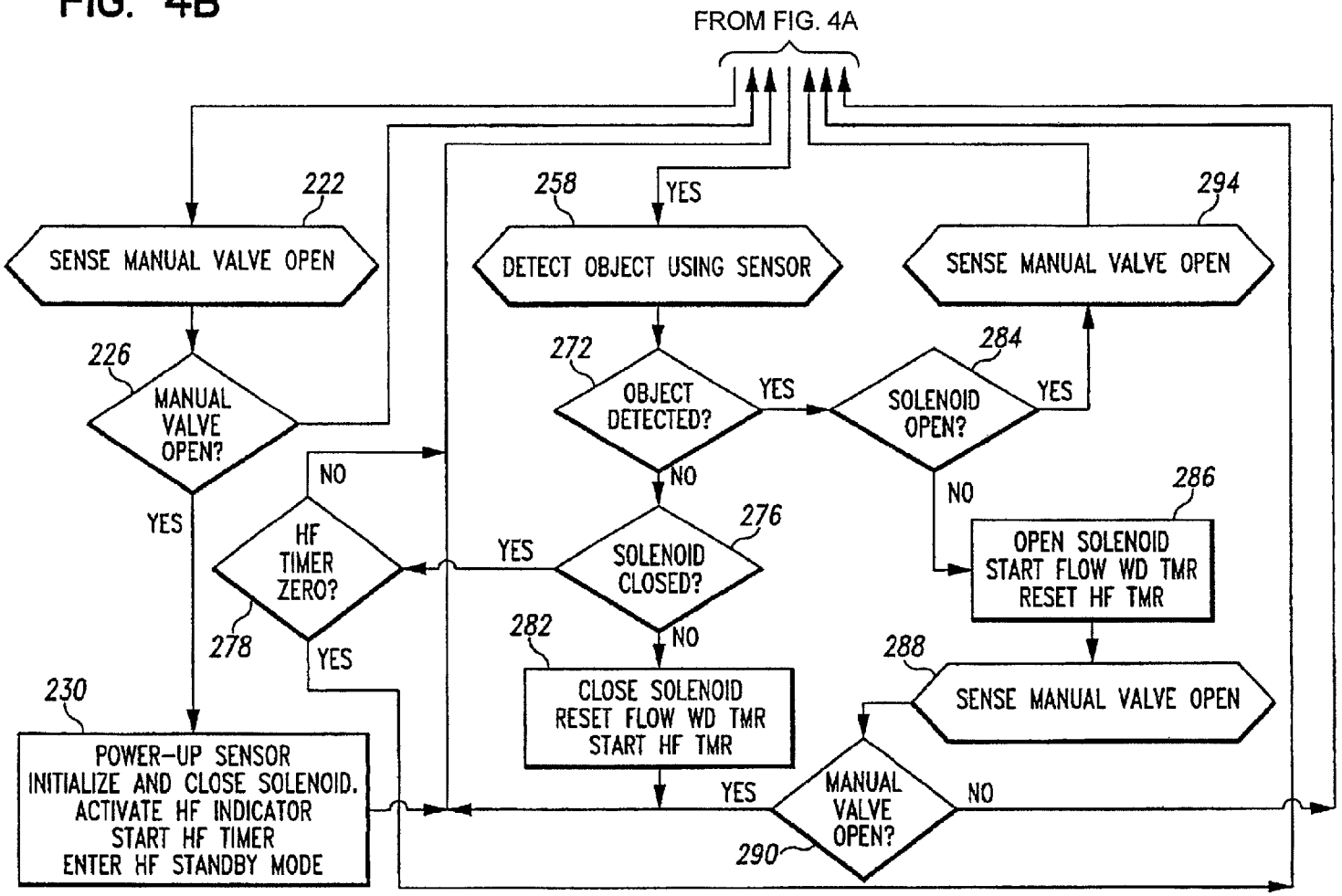

FIGS. 4A and 4B are a flowchart illustrating the logical control 119 for a preferred embodiment faucet according to the present invention. The logical control 119 begins each use session at 200, when the manual handle 118 is used to open the manual valve 104. At this time, the faucet is in the manual mode (which fact will be displayed by the mode indicator 134, in those embodiments wherein the mode sensor does not simply activate to indicate hands-free mode). At 214 the mode selectors, including the touch sensor in the spout and the touch-button, are monitored for instructions from the user to enter hands-free mode. At 218 it is determined whether the hands-free mode has been enabled. If not, the logical control 119 returns to 200. If at 218 it is determined that the hands-free mode has been enabled, at 222 the flow sensor is monitored to determine whether the manual valve is open. At 226 it is determined whether the manual valve 104 is open. If not, the logical control 119 returns to 214. If at 226 it is determined that the manual valve 104 is open, hands-free mode is activated at 230.

At 230, hands-free mode is activated by powering up the proximity sensor, initializing and closing the electrically operable valve 132 (thereby shutting off water flow), activating the mode indicator 134 to display hands-free mode, and initializing the hands-free timer. At this time, the faucet is in hands-free standby mode.

At 234 the mode selectors are monitored for instructions to return to manual mode. At 238, it is determined whether manual mode has been enabled. If so, at 242 it is determined whether the electrically operable valve 132 is open. If at 238 it is determined that manual mode has not been enabled, at 246 the manual handle position is sensed, and at 254 it is determined whether the manual valve 104 is open. If not, at 242 it is determined whether the electrically operable valve 132 is open.

If at 242 it is determined that the electrically operable valve 132 is closed (a "No" result), at 262 the solenoid is opened, and the mode indicator 134 is set to no longer display hands-free mode. If at 242 it is determined that the electrically operable valve 132 is open, or after it is opened at 262, then at 266 the proximity sensor is powered down and the hands-free and watchdog timers are reset. At this time the faucet is in manual mode, and the logical control 119 returns to 200.

If at 254 it is determined that the manual valve 104 is open, then at 258 the proximity sensor is monitored. At 272 it is determined whether the proximity detector has detected an object that should activate water flow. If not, at 276 it is determined whether the solenoid is closed. If at 276 it is determined that the solenoid is closed, at 278 it is determined whether the hands-free timer has expired. If at 278 the hands-free timer has not expired, the logical control 119 returns to 234; otherwise it proceeds to 280, where the solenoid is closed, and the mode indicator 134 is activated to indicate the timeout condition, after which the logical control 119 passes to 266. If at 276 it is determined that the solenoid is not closed, then at 282 the solenoid is closed, the watchdog timer is reset, and the hands-free timer is started, and the logical control 119 then returns to 234.

If at 272 it is determined that an object has been detected which requires that water flow be started, then at 284 it is determined whether the electrically operable valve 132 is open. If not, at 286 the solenoid is opened, the watchdog timer is started, and the hands-free timer is restarted. Then, at 288 the manual valve status is sensed. At 290 it is determined whether the manual valve 104 is open. If so, the logical control returns to 234. Otherwise, at 292 the mode indicator is activated to indicate that the faucet is no longer in hands-free mode, and the logical control 119 then passes to 266.

If at 284 it is determined that the electrically operable valve 132 is open, then at 294 the manual valve status is sensed. At 296 it is determined whether the manual valve 104 is open. If not, the logical control 119 proceeds to 292. If at 296 it is determined that the manual valve 104 is open, then at 298 it is determined whether the watchdog timer has expired. If not, the logical control 119 returns to 234, but if so, the logical control proceeds to 280.

In the illustrative embodiment the spout of the faucet is a "pull-down" spout. Those skilled in the art will appreciate that a pull-down spout is a spout that includes an extendible hose that connects it to the valve assembly, thereby permitting the spout to be pulled out from its rest position, where it can be used similarly to a garden hose, to direct water as the user wishes. In the preferred embodiment, when the pull-down spout is extended the faucet the electrically operable valve is automatically opened, so that water flow is controlled by the manual handle. In certain embodiments, this is effected by returning the faucet to manual mode. In certain other embodiments, though, when the spout is retracted the faucet resumes hands-free operation (assuming it was in hands-free mode when the spout was extended). Thus, in these embodiments, when the spout is extended the faucet effectively enters another mode. Note that this mode need not be distinguished from the hands-free mode by the mode indicator, though, since its presence will be obvious and intuitively understood because of the extended spout. Preferably, the electrically operable valve can be toggled by the tap control during this extended-spout mode.

In the illustrative embodiment, the automatic faucet detects that the pull-down spout has been pulled down using Hall-Effect sensors. However, it will be appreciated that any suitable means of detecting that the pull-down spout has been extended may be used.

Figure 5:
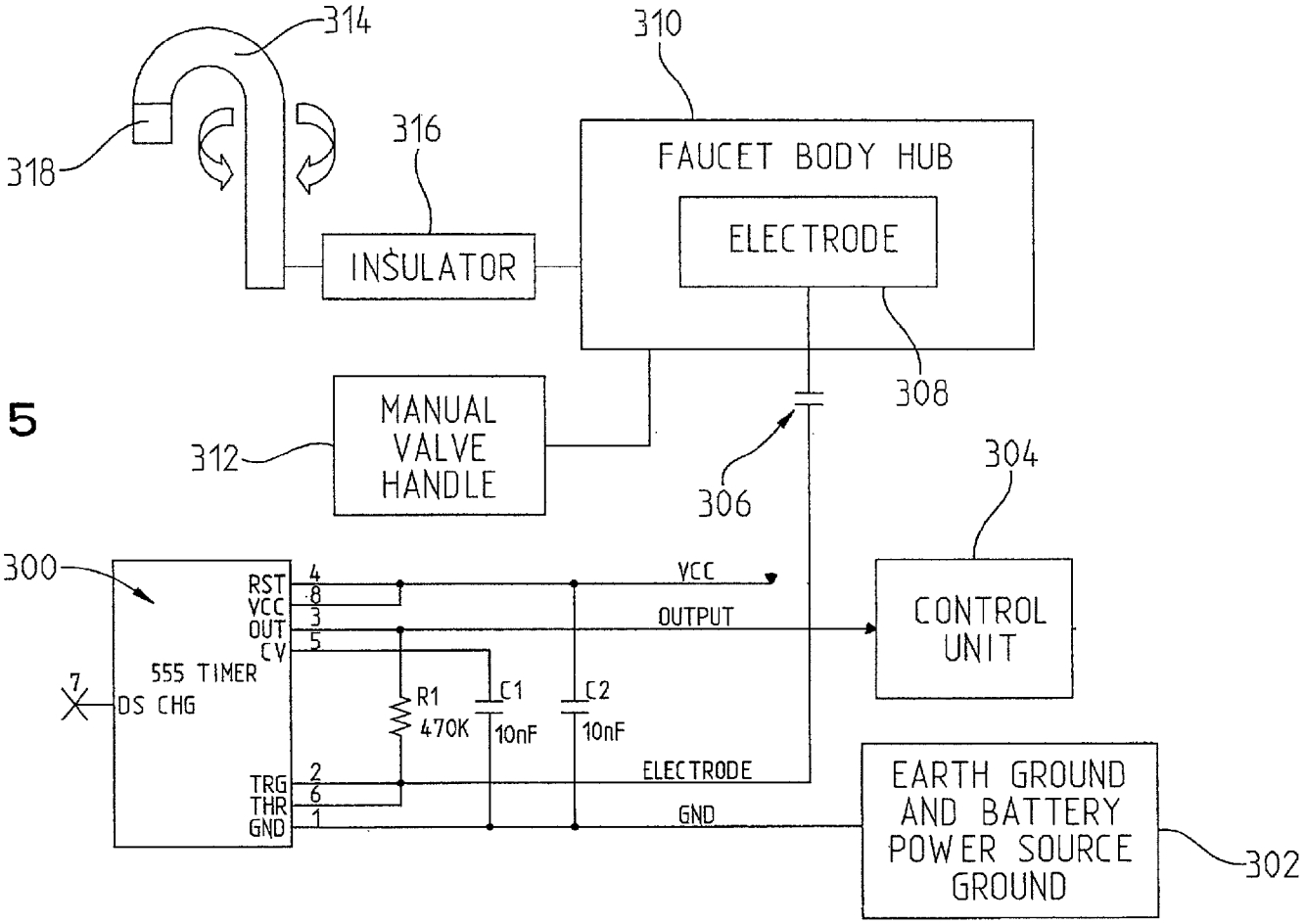
FIG. 5 is a block diagram with schematic portions illustrating another embodiment of the present invention which provides a capacitive sensor for use with a single hole mount faucet.
Figure 6:
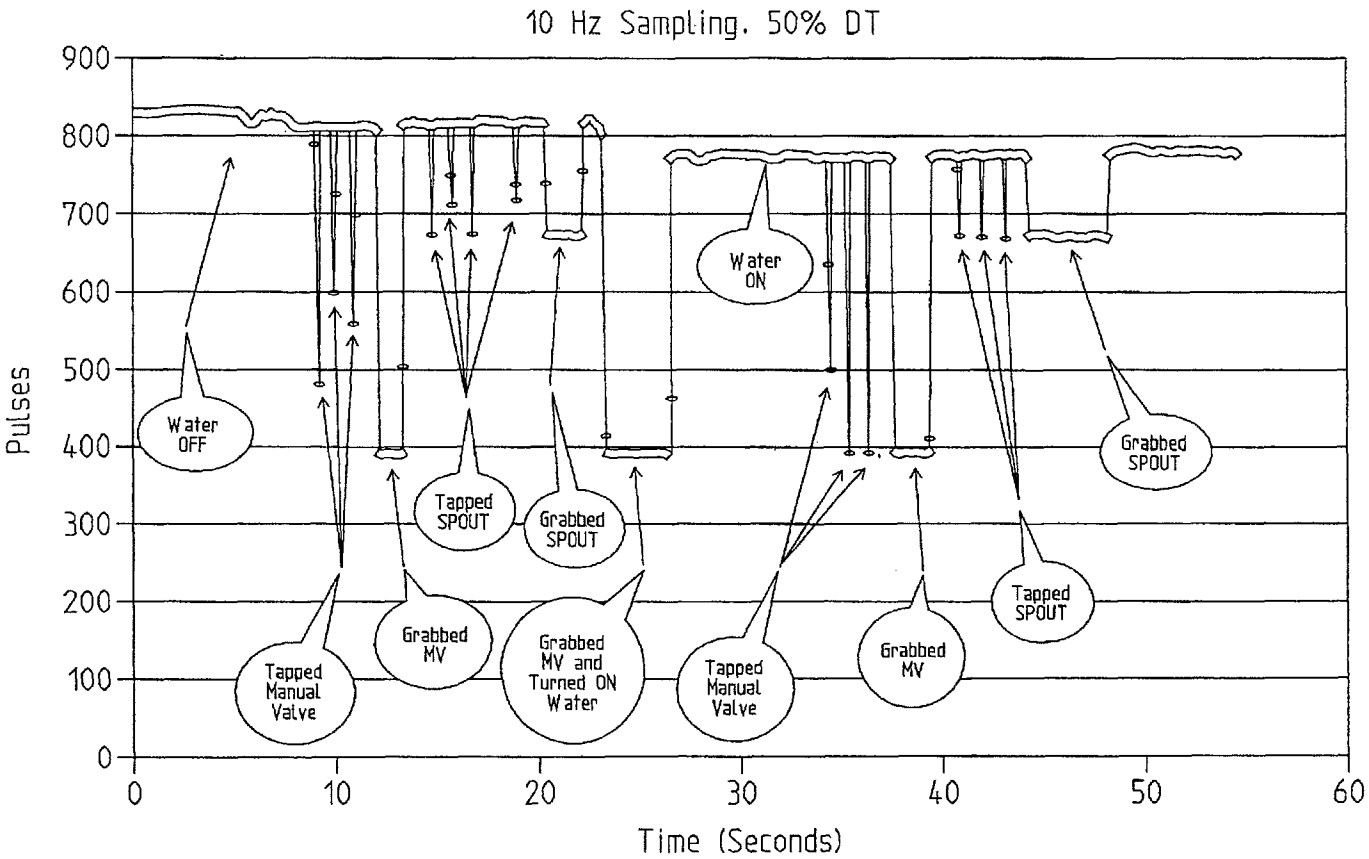
FIG. 6 is an illustrative output from the capacitive sensor of the embodiment of FIG. 5.

Another embodiment of the present invention is illustrated in FIGS. 5 and 6. In this embodiment, a capacitive sensor is provided for use with a single hole mount faucet. In the illustrated embodiment of FIG. 5, a timer integrated circuit such as, for example, a 555 timer 300 is used as the capacitive sensor. Timer 300 may be a IMC 7555 CBAZ chip. It is understood that other types of capacitive sensors may also be used in accordance with the present invention. Pins of the timer 300 are shown in FIG. 5.

In the illustrated embodiment, pin 1 of timer 300 is coupled to earth ground and to a battery power source ground as illustrated at block 302. An output of timer 300 is coupled to a controller 304 which is similar to controller 116 discussed above. Pin 2 of timer 300 is coupled through a 1 nF capacitor 306 to an electrode 308. Electrode 308 is coupled to the faucet body hub 310. Faucet body hub 310 is also electrically coupled to a manual valve handle 312, for example by metal-to-metal contact between the handle 312 and the hub 310. Manual valve handle 312 is movably coupled to the faucet body hub 310 in a conventional manner to control water flow. Since the manual valve handle 312 and the faucet body hub 310 are electrically connected, the electrode 308 may also be coupled to the manual valve handle 312, if desired.

A spout 314 is coupled to faucet body hub 310 by an insulator 316. In one embodiment, such as for a kitchen faucet, the spout 314 is rotatable relative to the faucet body hub 310. In other embodiments, the spout 314 may be fixed relative to the faucet body hub 310. Spout 314 may include a pull-out or pull-down spray head 318 which is electrically isolated from the spout 314.

The faucet body hub 310 provides sufficient capacitance to earth ground for the timer 300 to oscillate. As discussed above, the manual valve handle 312 is electrically connected to the faucet body hub 310. The spout 314 is capacitively coupled to the body hub by insulator 316 to provide approximately a 10-15 pF capacitance. When the manual valve handle 312 is touched by a user's hand, the capacitance to earth ground is directly coupled. The capacitive sensor therefore detects a larger capacitance difference when the handle 312 is touched by a user compared to when the spout 314 is touched. This results in a significant frequency shift when the manual valve handle 312 is touched by a user's hand. However, when the same user touches the spout 314, the frequency shift is substantially lower. For example, the frequency shift may be over 50% lower. By measuring the frequency shift compared to a baseline frequency, the controller 304 can detect where the faucet is touched and how long the faucet is touched to enable the controller to make water activation decisions as discussed herein.

FIG. 6 illustrates an output signal from pin 3 of timer 300 which is supplied to controller 304. The controller 304 can determine whether the manual valve handle 312 is tapped (short duration, lower frequency) or grabbed (long duration, lower frequency) and whether the spout 316 is tapped (short duration, higher frequency) or grabbed (long duration, higher frequency). The controller 304 may use this information to control operation of the faucet in different modes. The embodiment of FIGS. 5 and 6 may also be used with a proximity sensor (not shown), if desired, for a hands free mode.

While the invention has been illustrated and described in detail in the drawings and foregoing description, the description is to be considered as illustrative and not restrictive in character. Only the preferred embodiments, and such alternative embodiments deemed helpful in further illuminating the preferred embodiment, have been shown and described. It will be appreciated that changes and modifications to the forgoing can be made without departing from the scope of the following claims.

The invention claimed is:

1. A faucet comprising:
- a spout;
- a handle;
- a touch control operably coupled to at least one of the spout and the handle;
- a proximity sensor having an active state and an inactive state;
- a logical control operably coupled to the touch control and the proximity sensor, the logical control including:
  - a first mode, wherein the proximity sensor is inactive;
  - a second mode, wherein the proximity sensor is active; and
- a mode indicator configured to provide a visual indication of at least one of the first mode and the second mode.

2. The faucet of claim 1, wherein the first mode is a manual mode such that positioning of the handle toggles water flow on and off.

3. The faucet of claim 1, wherein the second mode is a hands-free mode such that changes in the state of the proximity sensor toggles water flow on and off.

4. The faucet of claim 1, wherein the first mode is a touch mode such that tapping one of the handle and the spout toggles water flow on and off.

5. The faucet of claim 4, wherein tapping comprises a touch of less than approximately 250 milliseconds.

6. The faucet of claim 1, wherein the logical control further includes a mode controller that moves the faucet between the first mode and the second mode.

7. The faucet of claim 6, wherein the mode controller changes the faucet between the first mode and the second mode in response to a substantially simultaneous grasping of the spout and tapping of the handle.

8. The faucet of claim 7, wherein:
- grasping of the spout comprises a touch of greater than approximately 250 milliseconds; and
- tapping of the handle comprises at least one touch of less than less than approximately 250 milliseconds.

9. The faucet of claim 8, wherein the tapping of the handle comprises two sequential touches, each touch being less than approximately 250 milliseconds.

10. The faucet of claim 1, wherein the mode indicator comprises at least one light emitting device.

11. The faucet of claim 10, wherein the at least one light emitting device is configured to selectively display light of different colors.

12. The faucet of claim 10, wherein the at least one light emitting device emits no light when the logical control is in the first mode, and the at least one light emitting device emits a light of a first color when the logical control is in the second mode.

13. The faucet of claim 12, wherein the at least one light emitting device emits a light of a second color to indicate a low battery condition.

14. The faucet of claim 10, wherein the at least one light emitting device emits light of a first color when the logical control is in the first mode and water is toggled on, and the at least one light emitting device emits light of a second color when the logical control is in the second mode and water is toggled on.

15. The faucet of claim 1, further comprising a manual valve coupled to the handle.

16. The faucet of claim 15, further comprising an electrically operable valve configured to control water flow through the spout, wherein the manual valve is fluidly coupled in series with the electrically operable valve.

17. The faucet of claim 1, wherein the touch control comprises a single sensor electrically coupled to both the spout and the handle.

18. The faucet of claim 1, wherein the touch control comprises a first sensor electrically coupled to the spout and a second sensor electrically coupled to the handle.

19. The faucet of claim 1, further comprising an audio device configured to provide an audible indication of transition between the first mode and the second mode.

20. A faucet comprising:
- a spout;
- a handle;
- a capacitive sensor operably coupled to at least one of the spout and the handle;
- an electrically operable valve configured to control water flow through the spout;
- a logical control operably coupled to the capacitive sensor and the electrically operable valve; and
- a mode indicator including a light emitting device configured to provide an indication of a plurality of modes of operation of the faucet, including a mode when water is flowing through the spout.

21. The faucet of claim 20, wherein the logical control provides touch sensing and proximity sensing.

22. The faucet of claim 21, wherein the logical control includes:
- a first mode, wherein the proximity sensing is inactive;
- a second mode, wherein the proximity sensing is active; and
- the mode indicator is configured to provide a visual indication of at least one of the first mode and the second mode.

23. The faucet of claim 22, wherein the logical control further includes a mode controller that changes the faucet between the first mode and the second mode in response to substantially simultaneous touching of the spout and the handle.

24. The faucet of claim 20, wherein the light emitting device is configured to selectively display light of different colors.

25. The faucet of claim 20, wherein the light emitting device is configured to emit a solid blue light when water is flowing.

26. The faucet of claim 20, further comprising a manual valve coupled to the handle.

27. The faucet of claim 26, wherein the manual valve is fluidly coupled in series with the electrically operable valve.

* * * * *